United States Patent [19]

Kurtz

[11] Patent Number: 4,497,676

[45] Date of Patent: Feb. 5, 1985

[54] GUNPOWDER SUBSTITUTED COMPOSITION AND METHOD

[76] Inventor: Earl F. Kurtz, 3607 Columbia Dr., Longmont, Colo. 80501

[21] Appl. No.: 437,965

[22] Filed: Nov. 1, 1982

[51] Int. Cl.[3] ..... C06B 45/00

[52] U.S. Cl. ..... 149/2; 149/21; 149/46; 149/61; 149/109.6; 102/431; 102/DIG. 700; 264/3 R; 264/3 C; 149/45

[58] Field of Search ..... 149/2, 46, 61, 21, 109.6, 149/45; 102/431, DIG. 700; 264/3 R, 3 C

[56] References Cited

U.S. PATENT DOCUMENTS 3,919,940 11/1975 Ploger et al. ..... 102/333 X
4,068,589 1/1978 Oversohl ..... 102/465

*Primary Examiner*—Stephen J. Lechert, Jr.
*Attorney, Agent, or Firm*—Jerry W. Berkstresser; Bruce G. Klaas; Klaas & Law

[57] ABSTRACT

A gunpowder substitute which is capable of also being molded into a consumable cartridge or cartridge case comprising between 50% to 75% by weight of an inorganic nitrate and between 25% to 50% by weight of an organic acid including ascorbic acid, erythorbic acid and mixtures thereof.

20 Claims, No Drawings

GUNPOWDER SUBSTITUTED COMPOSITION AND METHOD

BACKGROUND OF THE INVENTION

This invention relates to a combustible substitute for previously formulated gunpowder based compositions and other combustible formulations useful for propellent and other pyro-technic, explosive and the like kinds of applications.

The previous need for various formulations for use as gunpowder or propellents or explosive compositions has produced a wide variety of compositions, often utilizing basic well known gunpowder constituents as well as many materials of a more exotic nature. Even with the extensive work done over the years in the area of ammunition, explosives and propellents, few compositions have successfully achieved utility for several applications and none has successfully replaced the basic ingredients of well known gunpowder formulations for general ammunition use.

Many combustible compositions having utility as gunpowders, explosives, propellents or other pyrotechnic uses, employ inorganic nitrates, including ammonium nitrate, as the oxidizer portion of the composition singly or sometimes in combination with other oxidizers. In particular ammonium and potassium nitrates are employed as preferred oxidizers in many pyrotechnic formulations due to their low cost and the widespread availability of the materials. Great care however, must be exercised in compounding formulations containing inorganic nitrates to avoid contact with organic or other easily oxidizable materials since the flamability and potential explosive characteristic of the resultant materials has to be carefully evaluated for safety reasons. It has, however, always been desirable to obtain pyrotechnic compositions that are safe handling and yet tend to burn predictably and yet completely and therefore efficiently with little ash or residue. This objective has been difficult to obtain in combination with safe handling due to the powerful and often unpredictable oxidizer activity of the inorganic nitrates.

BRIEF DESCRIPTION OF THE INVENTION

Even though much work has been done in this area, the foregoing objective has not been achieved to the degree now possible by the formulation of an inorganic nitrate together with either or both isomeric forms of the organic acid ascorbic acid. It has been discovered in particular that a composition containing between 50% to 75% by weight of potassium nitrate and 25% to 50% by weight of erythorbic acid prepared as further described herein produced a stable, efficient composition for use as a substitute for a wide variety of gunpowder formulations, including black powder, as well as being suitable for consumable cartridges and cartridge cases and solid propellent applications. Other applications are also possible including use as either a solid or liquid fuel substitute.

DETAILED DESCRIPTION OF THE INVENTION

In the practice of the present invention, the ascorbic acid and erythorbic acid can be obtained commercially and no specific further preparation for its use in this invention was necessary although it may be desirable to grind or otherwise reduce the size of the powder or crystals that are sold commercially. Likewise, the inorganic nitrates used may be ground or otherwise reduced in size to facilitate their use in the described process.

The following examples are exemplary of the kinds of compositions that can be formulated following the practice of the present invention. The resultant compositions and cartridges have shown great utility when used as either a replacement for black powder, smokeless powder, as a totally consumable cartridge case or as totally consumable cartridge.

EXAMPLE 1

Initially six (6) parts by weight of $12KNO_3$ (Potassium Nitrate) and four (4) parts by weight of short cellulosic fibers obtained from James River Corporation (commercial designation K S 1016) are slurried together in sufficient water to form a uniform slurry or paste. Six (6) parts by weight of $KNO_3$ and four (4) parts by weight of erythorbic acid (obtained from Pfizer Chemical Corporation) are mixed together with a sufficient quantity of water to form a clear solution. The two solutions are thoroughly mixed together and the resultant solution and slurry spread into a thin film or in a shallow container and dried. Preferrably the formulation of each of the component parts is accomplished by first dissolving the $KNO_3$ completely each time before adding the second constituent of each part, adding further water if necessary. It is also desirable to use lukewarm water to facilitate dissolution though that is not essential to successfully compound the final product. The mixed components are either dried at room temperature or at an elevated temperature as desired. If an elevated temperature is selected, it is important that the temperature be controlled to prevent the dried mixture from exceeding a temperature of approximately 175° F. (79° C.) at temperatures above about 184° F. (84° C.) the erythorbic acid will undergo undesirable decomposition the products of which can produce a hazardous condition in the presence of the strong oxidizer, $KNO_3$. During the drying process, when elevated temperatures are employed, a color change will occur and the dry mixture will take on a golden brown color. Care must be taken to avoid the formation of a deep red color in the mixture as that can be an indication that the constituents have either reacted due to an exclusively high temperature which should be avoided as previously described.

It is important that further heating should cease if the deep red color described occurs in any of the mixture. The mixture thus prepared can be used as a black powder substitute.

EXAMPLE II

The dried mixture of Example I can be packed into a mold, shaped, and sized to produce a caseless cartridge or a solid totally consumable cartridge. The dry powder is then subjected to between 10,000 lbs. per square inch (7.0 kg per $mm^2$) and 14,000 lbs. per square inch (9.8 kg per $mm^2$)

In the preferred practice of the present invention, it is desirable to also provide a heated mold, again maintained at a temperature such that the temperature of the mixed constituents do not exceed a temperature of about 175° F. (79° C.). The heating of the mold facilitates the flow and proper compaction of the mixture during the forming process and aids in the production of a consumable cartridge case or consumable cartridge which exhibits the required physical properties for its use in that form. After the pressure compaction described, which if properly done produces a sturdy cartridge case without deleteriously affecting the burning properties of the mixture, a conventional projectile may be seated into the end of the caseless cartridge utilizing a sealing adhesive suitable for that purpose. Practically any conventional acetone based adhesive such as Duco Brand cement or modelers cement can be used as well as casein based adhesives, polyester adhesives, epoxy adhesives or the like. It is only important in the selection and use of such adhesives that a seal is produced which will withstand the rigors of normal handling as well as providing no deleterious effect during the combustion of the case or cartridge. The resultant case and projectile when properly filled with a conventional primer, which can be affixed in a manner similar to the projectile when received in a primer pocket provided in the case for that purpose, will function in the same manner as a conventional primer cartridge case, powder and projectile combination without significant residue in the bore of the weapon and with similar if not superior ballistic performance. In the preferred practice of the present invention, the cartridge case with primer and projectile adhesively applied are coated externally with a water repellent resin such as fluid silicone such as Dow Corning 1107 fluid which has been catalyzed with Dow Corning XY 176 catalyst to provide a smooth water repellent exterior surface for the combination. The cartridge should of course conform in physical dimensions to the planned use for the cartridge with the primer pocket cup shaped projectile receiving end of the cartridge being shaped and sized for close approximation of the necessary dimensions for receiving the primer and projectile in a relationship to accomplish the desired results.

EXAMPLE III

The composition of Example I may also be formed under pressure as described in Example II into a cartridge case into which a primer pocket is formed as described and a projectile can be received as described and where in addition the walls of the cartridge are formed so as to provide an open space from the projectile end of the cartridge to the exposed primer so that the space provided can be used to contain a power or propellent of choice other than the solid formed consumable cartridge. The powder of choice may be selected from conventional gun powders or even use the formulation of Example I to achieve the desired burning rate, chamber pressures and ballistic performance.

EXAMPLE IV

Initially six (6) parts by weight of $12KNO_3$ (Potassium Nitrate) and four (4) parts by weight of short cellulosic fibers obtained from James River Corporation (commercial designation K S 1016) are slurried together in sufficient water to form a uniform slurry or paste as in Example I. Six (6) parts by weight of $KNO_3$ and four (4) parts by weight of ascorbic acid (obtained from Pfizer Chemical Corporation) are mixed together with a sufficient quantity of water to form a clear solution. The two solutions are thoroughly mixed together and the resultant solution and slurry spread into a thin film or in a shallow container and dried. Preferrably the formulation of each of the component parts is accomplished by first dissolving the $KNO_3$ completely each time before adding the second constituent of each part, adding further water if necessary. It is also desirable to use lukewarm water to facilitate dissolution though that is not essential to successfully compound the final product. The mixed components are either dried at room temperature or at an elevated temperature as desired. If an elevated temperature is selected, it is important that the temperature be controlled to prevent the dried mixture from exceeding a temperature of approximately 175° F. (79° C.) at temperatures above about 184° (84° C.)since the ascorbic acid will undergo undesirable decomposition the products of which can produce a hazardous condition in the presence of the strong oxidizer, $KNO_3$. During the drying process, when elevated temperatures are employed, a color change will occur and the dry mixture will take on a golden brown color. Care must be taken to avoid the formation of a deep red color in the mixture as that can be an indication that the constituents have either reacted due to an exclusively high temperature which should be avoided as previously described.

It is important that further heating should cease if the deep red color described occurs in any of the mixture. The mixture thus prepared can be used as a black powder substitute.

EXAMPLE V

The dried mixture of Example IV can be packed into a mold, shaped, and sized to produce a caseless cartridge or a solid totally consumable cartridge. The dry powder is then subjected to between 10,000 lbs. per square inch (7 kg per $mm^2$) and 14,000 lbs. per square inch (9.8 kg per $mm^2$).

In the preferred practice of the present invention, it is desirable to also provide a heated mold, again maintained at a temperature such that the temperature of the mixed constituents do not exceed a temperature of about 175° F. (79° C.). The heating of the mold facilitates the flow and proper compaction of the mixture during the forming process and aids in the production of a consumable cartridge case or consumable cartridge which exhibits the required physical properties for its use in that form. After the pressure compaction described, which if properly done produces a sturdy cartridge case without deleteriously affecting the burning properties of the mixture, a conventional projectile may be seated into the end of the caseless cartridge utilizing a sealing adhesive suitable for that purpose. Practically any conventional acetone based adhesive such as Duco Brand cement or modelers cement can be used as well as casein based adhesives, polyester adhesives, epoxy adhesives or the like. It is only important in the selection and use of such adhesives that a seal is produced which will withstand the rigors of normal handling as well as providing no deleterious effect during the combustion of the case or cartridge. The resultant case and projectile when properly filled with a conventional primer, which can be affixed in a manner similar to the projectile when received in a primer pocket provided in the case for that purpose, will function in the same manner as a conventional primer cartridge case, powder and projectile combination without significant residue in the bore of the weapon and with similar if not superior ballistic performance. In the preferred practice of the present invention, the cartridge case with primer and projectile adhesively applied are coated externally with a water repellent resin such as fluid silicone such as Dow Corning 1107 fluid which has been catalyzed with Dow Corning XY 176 catalyst to provide a smooth water repellent exterior surface for the combination.

The cartridge should of course conform in physical dimensions to the planned use for the cartridge with the primer pocket cup and shaped projectile receiving end of the cartridge being shaped and sized for close approximation of the necessary dimensions for receiving the primer and projectile in a relationship to accomplish the desired results.

EXAMPLE VI

The composition of Example IV may also be formed under pressure as described in Example V into a cartridge case into which a primer pocket is formed as described and a projectile can be received as described and where in addition the walls of the cartridge are formed so as to provide an open space from the projectile end of the cartridge to the exposed primer so that the space provided can be used to contain a power or propellent of choice other than the solid formed consumable cartridge. The powder of choice may be selected from conventional gun powders or even use the formulation of Example IV to acheive the desired burning rate, chamber pressures and ballistic performance.

As previously described approximately 75% by weight of the $KNO_3$ is utilized in the combination including 25% by weight ascorbic or erythorbic acid. For purposes of calculating the proportions of constituents, the total weight of oxidizer and either one or a mixture of both acids will be the reference and the proportion of oxidizer and acid to that total is provided. From the examples, it can be seen that other materials, such as short cellulosic fibers can be encorporated in an amount found to be suitable for the described handling and combustion characteristics. In the compositions of the present invention, it has been discovered that proportions of the acid component can vary between about 25% to 50% by weight as described and the oxidizer employed can be used in amounts of from about 50% to 75% by weight and still achieve the desired results. The examples are at the high end of the oxidizer range and the low end of the acid range however, different performance characteristics may be desired for different applications and the compositions may be adjusted and tested without undue experimentation to achieve the desired results.

The method of manufacture described has been found to satisfactorily produce the specific results sought with these ranges of oxidizer and acid. Different requirements including higher or lower chamber pressures and different ballistic characteristics can again be obtained by varying the composition, the additives, the primer and the weight or other characteristics of the projectile utilizing known techniques used in the ammunition industry again without undue experimentation.

The foregoing description of possible embodiments of the present invention are therefore exemplary only. It is possible within the scope of this disclosure to produce a very wide variety of specific compositions capable of functioning in many specific applications including, pyrotechnics, propellents and gun powder substitution applications as well as the consumable cartridge case and consumable cartridge described. This invention is therefore limited only by the prior art and the appended claims.

What is claimed is:

1. A consumable cartridge comprising:

(a) a primer; and (b) a projectile; and (c) a molded cartridge case containing means for receiving said primer and means for receiving said projectile in association therewith for use in a firearm, said molded cartridge case comprising a composition made from an inorganic nitrate oxidizer and an organic acid selected from the group consisting of erythorbic acid, ascorbic acid, and mixtures thereof.

2. The consumable cartridge of claim 1 wherein the inorganic nitrate and organic acid are present in the molded cartridge in amounts, which when compared to the total weight of these two constituents, the nitrate comprises from about 50% to about 75% by weight and the acid comprises from about 25% to 50% by weight, before the cartridge is molded.

3. The consumable cartridge of claim 2 wherein the inorganic nitrate is potassium nitrate.

4. The consumable cartridge case comprising:

a molded cartridge case containing means for receiving a primer and means for receiving a projectile in association therewith suitable for use in a firearm, said molded cartridge case having a generally cylindrical shape and containing a composition prepared from a mixture of an inorganic nitrate oxidizer selected from the group consisting of potassium nitrate, ammonium nitrate and mixtures thereof, and an organic acid selected from the group consisting of erythorbic acid, ascorbic acid and mixtures thereof.

5. The consumable cartridge case of claim 4 wherein the inorganic nitrate and acid are present in the molded cartridge case in amounts which when compared to the total weight of these two constituents, the nitrate comprises from about 50% to 75% by weight and the acid comprises from about 25% to 50% by weight.

6. A method of making a consumable cartridge comprising the steps of (1) forming a slurry and solution of an oxidizer and an organic acid; (2) drying the slurry and solution mixture at a temperature below about 175° F. (79° C.); and (3) compacting the dried mixture in a mold to a preselected shape using between 10,000 lbs. per square inch and 14,000 lbs. per square inch to form the finished shape.

7. The method of claim 6 wherein said step of compacting includes heating the mixture while compacting to a temperature less than 175° F. (79° C.).

8. The method of claim 7 wherein the oxidizer is potassium nitrate and the acid is erythorbic acid, ascorbic acid or mixtures thereof.

9. The method of claim 8 wherein the slurry and solution includes cellulosic fibers.

10. A method of making a consumable cartridge case comprising the steps of (1) forming a slurry and solution of an oxidizer and an organic acid; (2) drying the slurry and solution mixture at a temperature below about 175° F. (79° C.); and (3) compacting the dried mixture in a mold to a preselected generally hollow cylindrical shape using between 10,000 lbs. per square inch and 14,000 lbs. per square inch to form the finished shape.

11. The method of claim 10 wherein said step of compacting includes heating the mixture while compacting to a temperature less than 175° 79° C.).

12. The method of claim 11 wherein the oxidizer is potassium nitrate and the acid is erythorbic acid, ascorbic acid or mixtures thereof.

13. The method of claim 12 wherein the slurry and solution includes cellulosic fibers.

14. A gunpowder substitute comprising:

a dry mixture of an inorganic nitrate oxidizer and an organic acid including erythorbic or ascorbic acid.

15. The gunpowder substitute of claim 14 wherein the inorganic nitrate and acid are present in amounts when compared to the total weight of these two constituents, the nitrate comprises from about 50% to 75% by weight and the acid comprises from about 25% to 50% by weight.

16. The gunpowder substitute of claim 15 wherein the inorganic nitrate is potassium nitrate, ammonium nitrate and mixtures thereof.

17. The gunpowder substitute of claim 16 wherein the organic acid is ascorbic acid, erythorbic acid and mixtures thereof.

18. A method of making a gunpowder substitute comprising the steps of (1) forming a slurry and solution of an oxidizer and an organic acid; (2) drying the slurry and solution mixture at a temperature below about 175° F. (79° C.); and (3) dry mixing the dried mixture.

19. The method of claim 18 wherein the oxidizer is potassium nitrate and the acid is erythorbic acid, ascorbic acid or mixtures thereof.

20. The method of claim 19 wherein the slurry and solution includes cellulosic fibers.

* * * * *